US005906503A

United States Patent [19]

Wiencek et al.

[11] Patent Number: 5,906,503

[45] Date of Patent: May 25, 1999

[54] MODULAR PLUG WITH AUTOMATICALLY STAGGERED WIRES

[75] Inventors: Donald Wiencek; Royal Jenner, both of Tinley Park; Russell Vanderhoof, Minooka, all of Ill.

[73] Assignee: Pauduit Corp., Tinley Park, Ill.

[21] Appl. No.: 08/760,932

[22] Filed: Dec. 6, 1996

[51] Int. Cl.[6] ..... H01R 4/24

[52] U.S. Cl. ..... 439/418

[58] Field of Search ..... 439/418, 425, 439/676

[56] References Cited

U.S. PATENT DOCUMENTS

| | | | |
|---|---|---|---|
| 4,002,392 | 1/1977 | Hardesty . | |
| 4,054,350 | 10/1977 | Hardesty . | |
| 4,143,935 | 3/1979 | Goodman et al. . | |
| 4,160,575 | 7/1979 | Schraut . | |
| 4,211,462 | 7/1980 | Wolfthal . | |
| 4,607,905 | 8/1986 | Vaden . | |
| 4,650,269 | 3/1987 | Denkmann et al. . | |
| 4,758,536 | 7/1988 | Miller et al. . | |
| 5,100,339 | 3/1992 | Sato et al. . | |
| 5,147,215 | 9/1992 | Pritulsky . | |
| 5,194,014 | 3/1993 | McClune et al. . | |
| 5,571,035 | 11/1996 | Ferrill | 439/676 X |
| 5,593,314 | 1/1997 | Lincoln | 439/418 OR |
| 5,624,274 | 4/1997 | Lin | 439/676 X |

*Primary Examiner*—Paula Bradley
*Assistant Examiner*—Daniel Wittels
*Attorney, Agent, or Firm*—Mark D. Hilliard; Michael J. Turgeon

[57] ABSTRACT

A modular plug connector that achieves category 5 cross talk performance is constructed with substantially parallel conductor positioning channels situated in a pair of spaced apart planar arrays to position individual conductors for termination by a plurality of flat insulation displacement contacts. A plurality of conductor guide ramps are formed such that upon insertion of the individual conductors, alternating conductors will be guided into their respective spaced apart array.

10 Claims, 6 Drawing Sheets

MODULAR PLUG WITH AUTOMATICALLY STAGGERED WIRES

TECHNICAL FIELD

The present invention relates generally to modular communication plug connectors for electrically terminating and connecting conductors of communication cables, and more specifically to a modular plug connector having an improved wire conductor insertion and positioning design.

BACKGROUND OF THE INVENTION

A wide variety of modular plugs of generally similar outward configuration, necessitated by the requirement of mating with a standard modular jack, are known in the communication industry. Modular plugs are relatively small in size, and terminate ends of communication cables whereby the individual wires are in close proximity thus inducing cross talk between different signal pairs. However, with the increase in data transmission rate requirements, the use of modular communication plugs and jacks to connect twisted pair cables in computer networks has resulted in a need to reduce the cross talk between signal transmitting wire pairs of the modular communication connectors. One method of reducing cross talk is achieved by staggering adjacent pairs of individual wires and minimizing the distance of the parallel runs.

The relatively small size of the plugs and conductors requires careful manipulation of the individual insulated conductors in arranging the order of the conductors relative to the contacts in the modular plug and for holding the conductors in the proper arrangement within the plug prior to being terminated. Typically, eight individual insulated conductors must be arranged and terminated to eight contacts in the plug. Providing the individual wires in a pair of spaced apart planes with alternating conductors being in alternating planes and situated such that the adjacent conductors have minimized parallel runs to reduce cross talk can be difficult to assemble. The individual conductors must either be preformed and carefully inserted into the individual channels or else initially positioned in a single planar array and forced into a staggered relationship.

Therefore, there is need for improvement in the art for a modular plug connector that can be easily terminated while reducing the cross talk induced by the connector in terminated wire pairs.

SUMMARY OF THE INVENTION

It is an object of the present invention to provide an improved modular plug connector that reduces cross talk between the conductor pairs terminated in the connector.

It is also an object of the present invention to provide an improved modular plug connector that provides for easier wire insertion of the individual wires into an improved relationship.

In general, a modular plug according to the present invention includes a connector for terminating a plurality of conductors of a plurality of conductor pairs, comprising a connector housing having a rear cable receiving opening formed by a top wall, a bottom wall and a pair of opposing side walls, a plurality of conductor positioning channels formed in a pair of offset planar arrays, and guide means for guiding the plurality of conductors into the pair of offset planar arrays of conductor positioning channels.

DESCRIPTION OF THE PREFERRED EMBODIMENT

Figure 1:
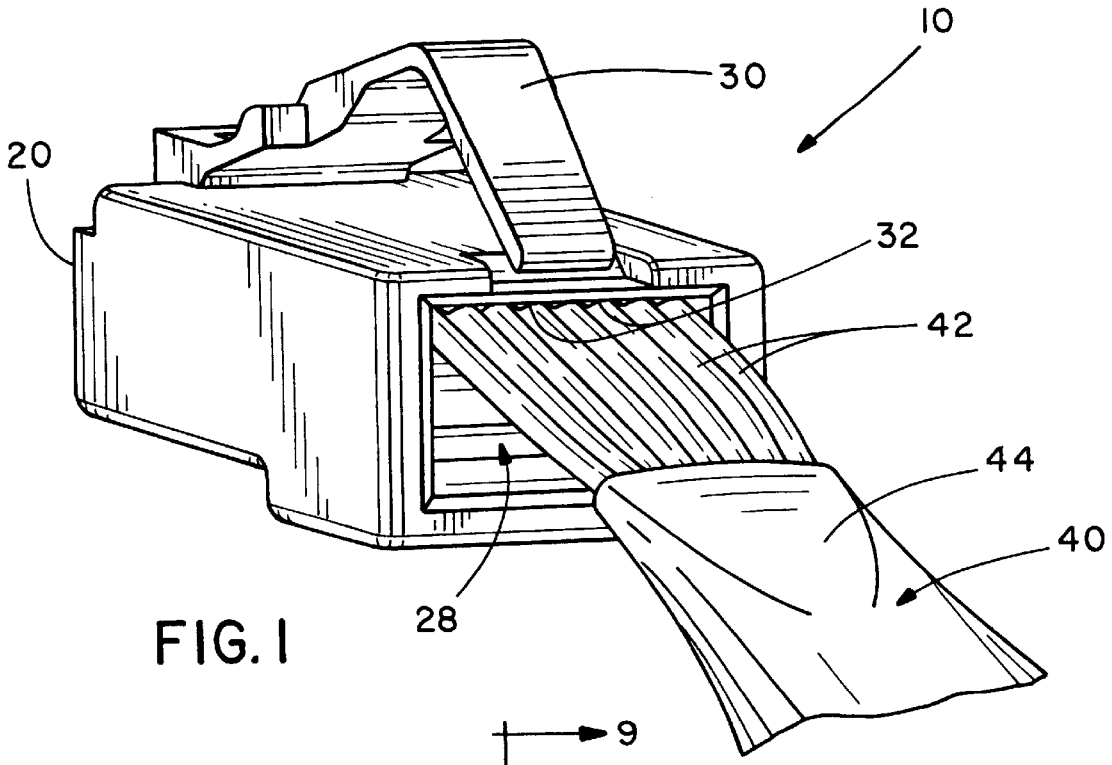
FIG. 1 is a perspective view of a modular plug connector, seen from the rear, embodying the concept of the present invention.

A modular communication plug connector embodying the concept of the present invention is designated generally by the reference numeral 10 in the accompanying drawings. Modular plug 10 is formed of a thermoplastic material and is designed to terminate a plurality of insulated conductors of a twisted pair cable.

Generally, the insulated conductors in signaled pairs are twisted together along their length within the cable to reduce cross talk between conductors 42 and are enclosed within a protective sheath 44 of cable 40. The cable 40 generally is stripped of its sheath 44 exposing four twisted wire pair conductors. These eight conductors 42 are then arranged into the proper color sequence, parallel to one another, and inserted into the housing as shown in FIG. 1. Connector 10 can also be used to terminate untwisted pair cable, flat cable or any other cable, the conductors of which are formed or can be formed into a planar array.

Figure 2:
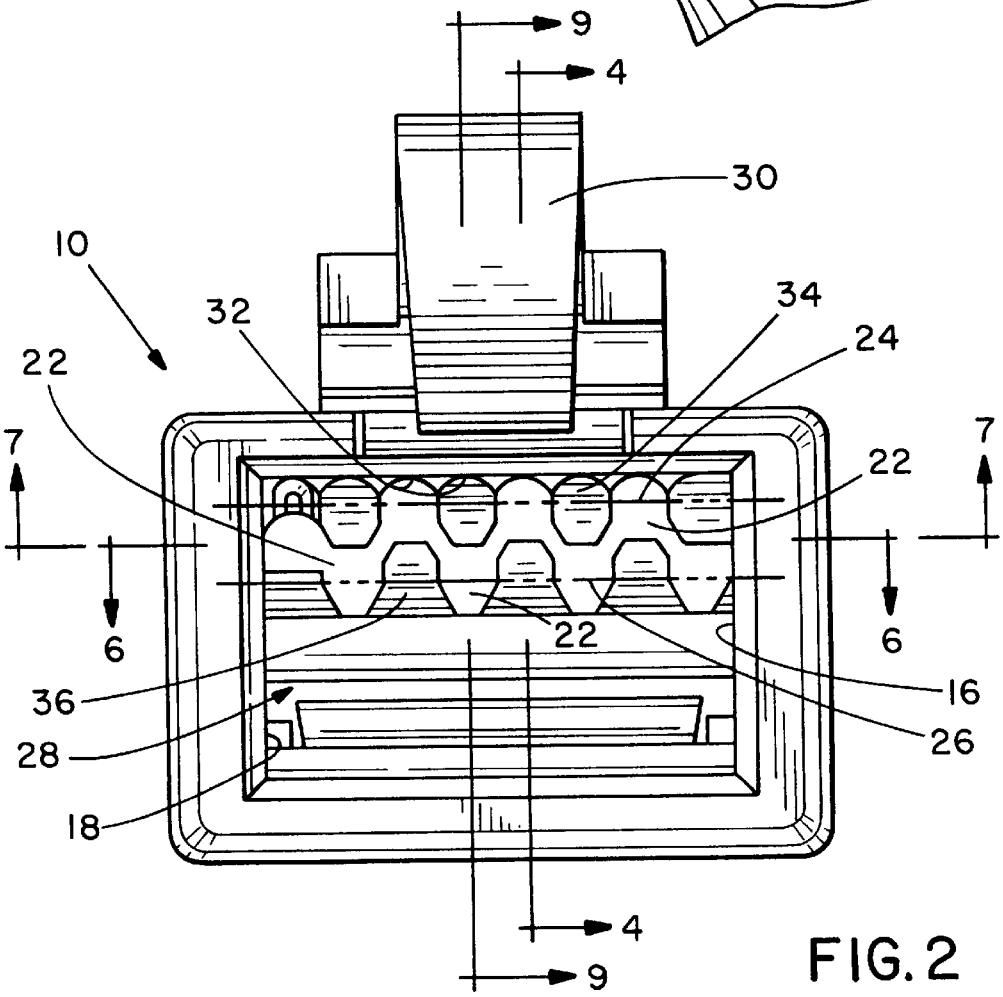
FIG. 2 is a rear view of the connector of FIG. 1.
Figure 3:
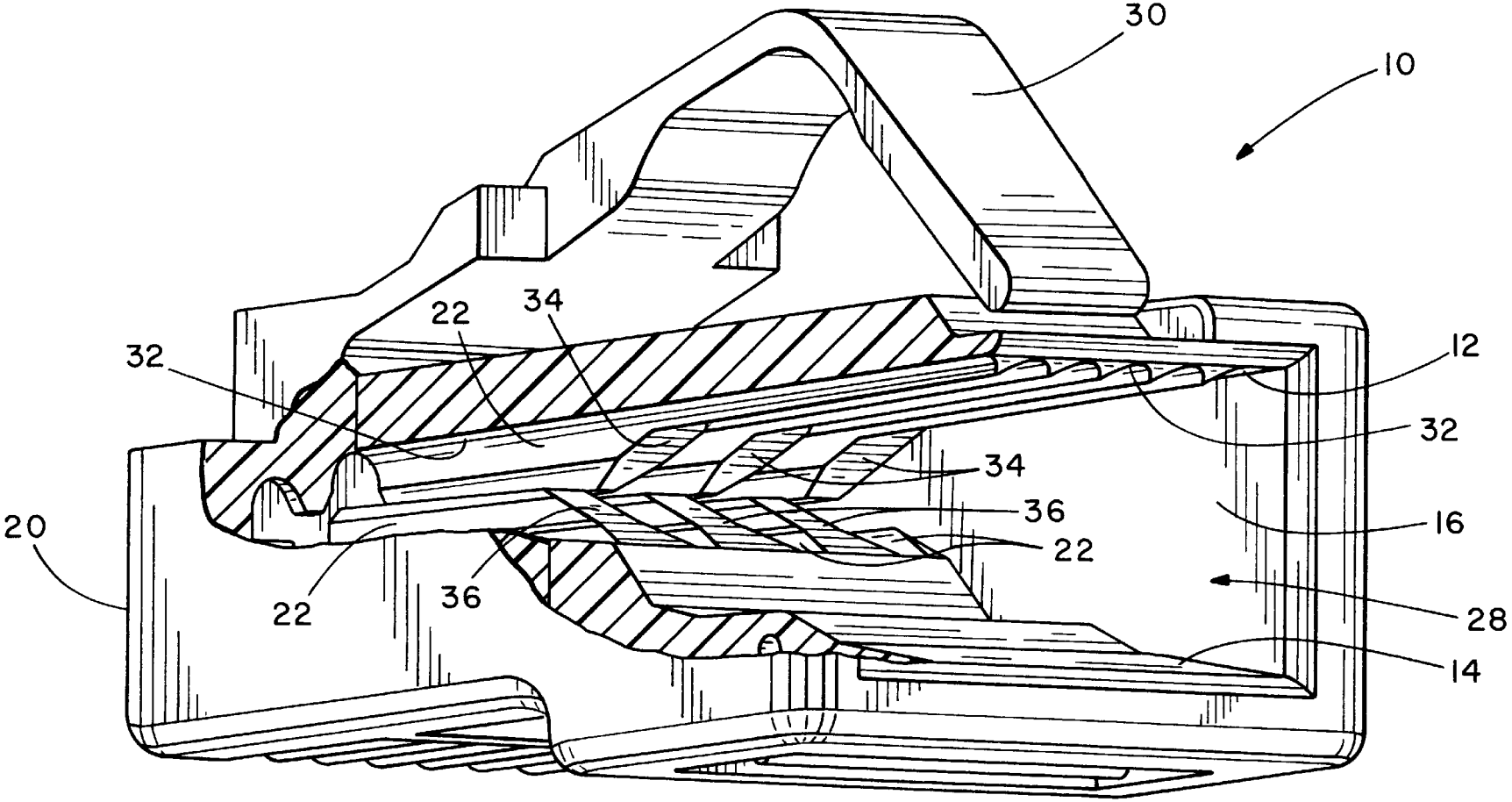
FIG. 3 is a fragmentary rear view of the modular plug connector of FIG. 1.
Figure 4:
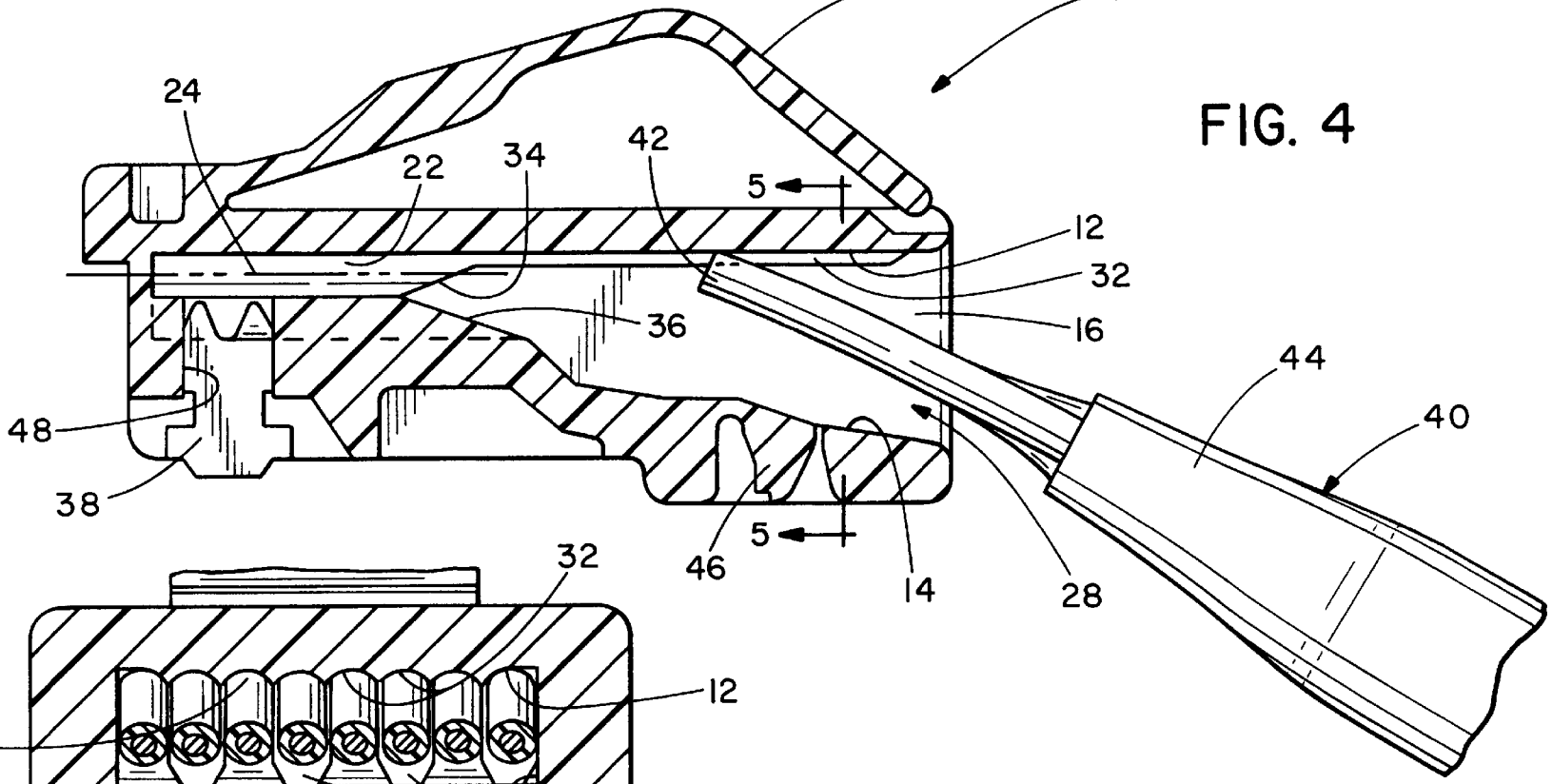
FIG. 4 is a sectional side view taken along lines 4—4 of FIG. 2 showing the initial insertion of an array of conductors into the connector of FIG. 1.
Figure 5:
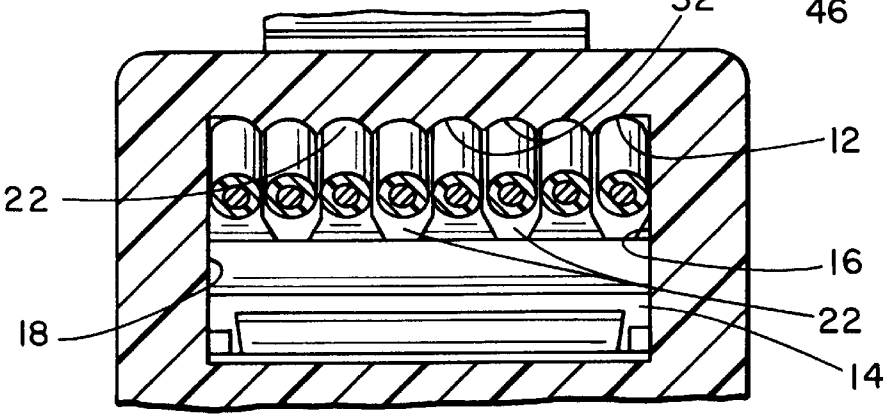
FIG. 5 is a sectional view taken along lines 5—5 of FIG. 4.
Figure 6:
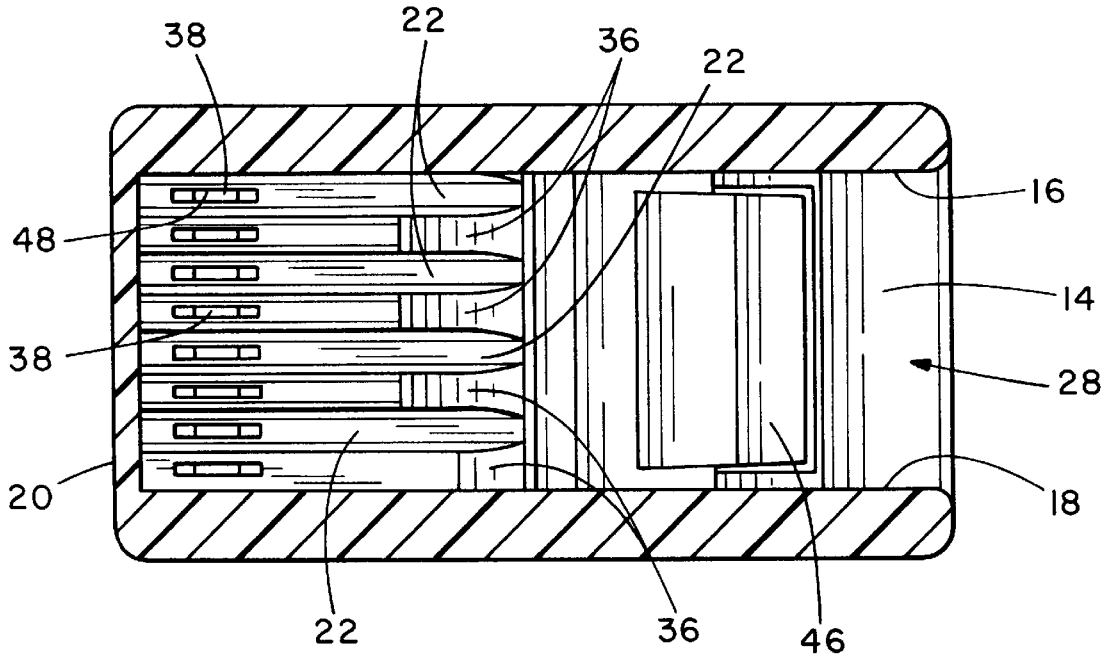
FIG. 6 is a sectional view taken along lines 6—6 of FIG. 2.
Figure 7:
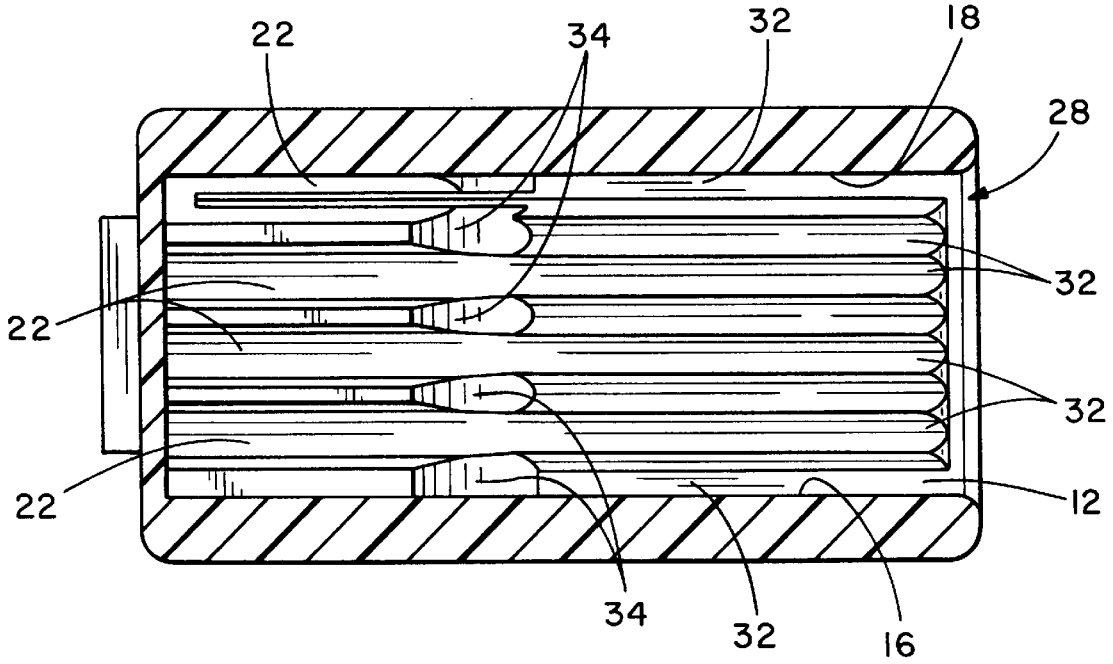
FIG. 7 is a sectional view taken along lines 7—7 of FIG. 2.
Figure 8:
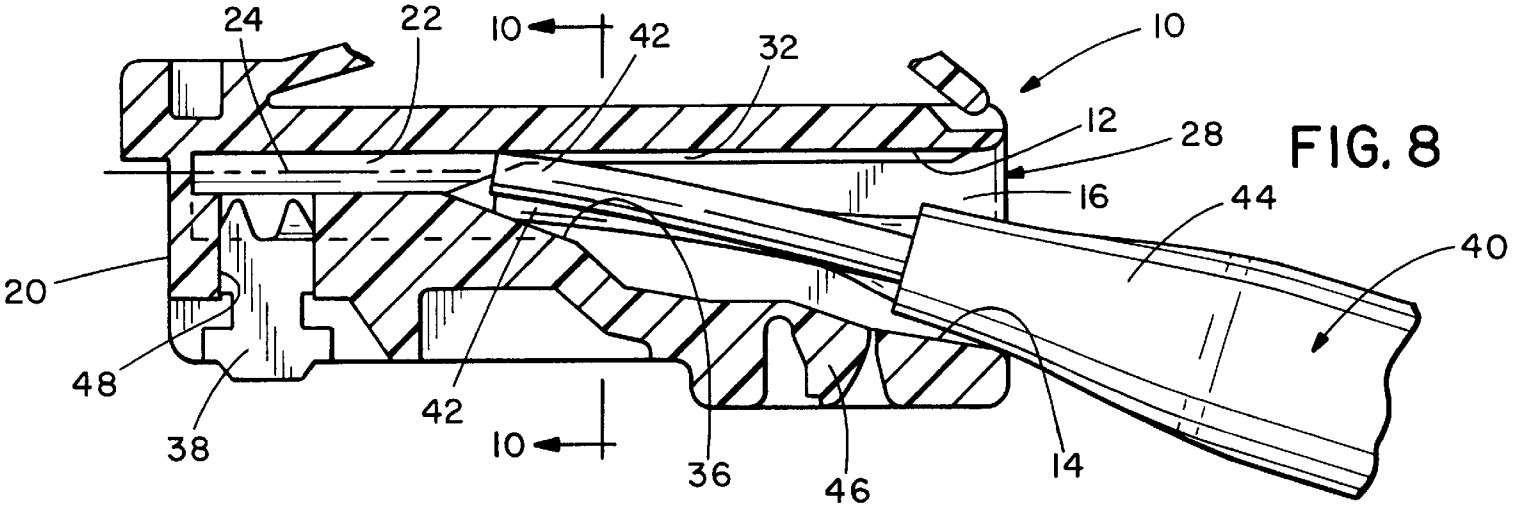
FIG. 8 is a sectional view taken along lines 4—4 of FIG. 2 showing the conductors further inserted into the connector.
Figure 9:
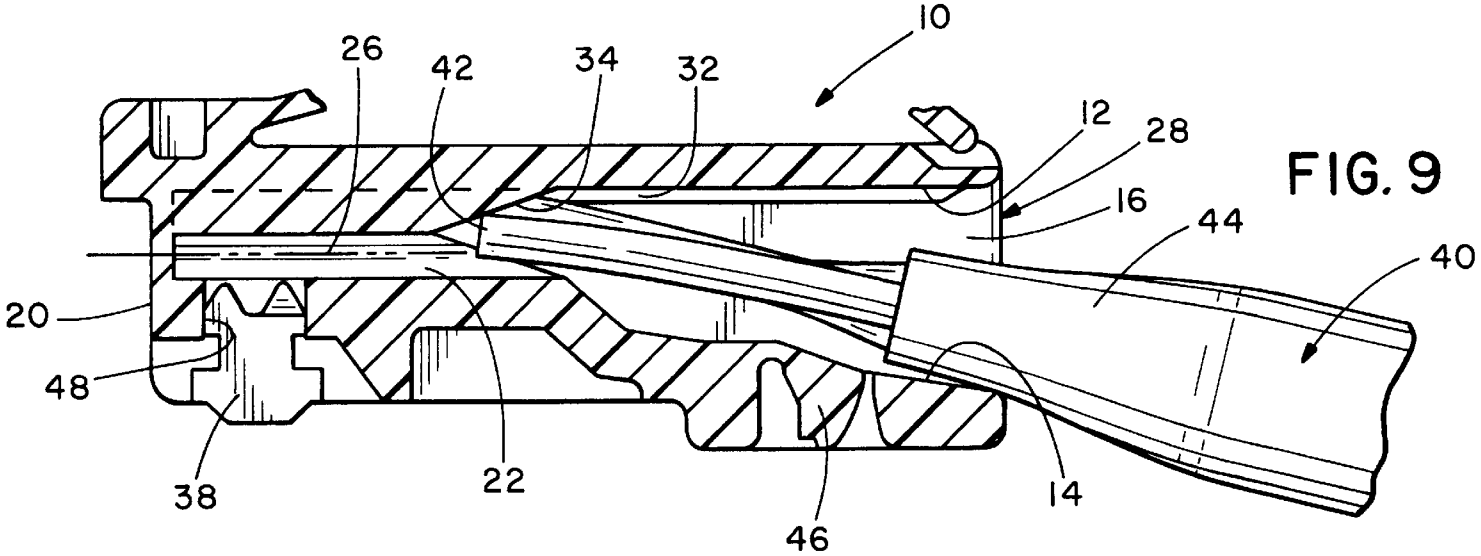
FIG. 9 is a sectional view taken along lines 9—9 of FIG. 2.
Figure 10:
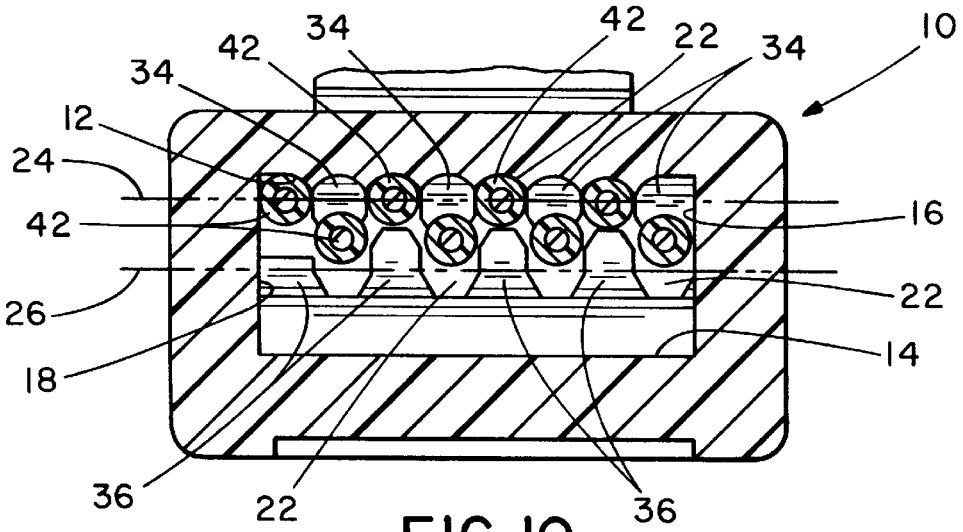
FIG. 10 is a sectional view taken along lines 10—10 of FIG. 8.

Modular plug 10 having a latch 30 is formed as a housing having a front face 20, and a rear cable receiving channel 28 defined by a top wall 12, first and second sidewalls 16, 18, and a bottom wall 14 as can be seen in FIGS. 2 and 3. As seen in FIG. 4, Channel 28 communicates with an array of eight conductor positioning channels 22 extending to the front face 20. The conductor positioning channels 22 are separated into an upper plane 24 and a lower plane 26. It is to be noted that as shown in FIG. 2, due to manufacturing constraints the far left conductor of the upper plane is slightly lower. As can be seen in FIGS. 3, 4, 6 and 7, a plurality of integrally formed ramp surfaces 34, 36 are situated within the cable receiving channel 28 so as to automatically receive and accurately position individual conductors 42 therebetween in the preferred spaced apart two-plane relationship. Upon sufficient insertion of the conductors 42 as shown in FIGS. 8 and 9, the top ramp surfaces 34 cause alternate conductors 42 to be deflected downward into the lower plane of conductor positioning channels 26. The bottom ramps 36 are positioned so as to automatically realign any stray conductors 42 back into the upper plane of conductor positioning channels 24.

Figure 11:
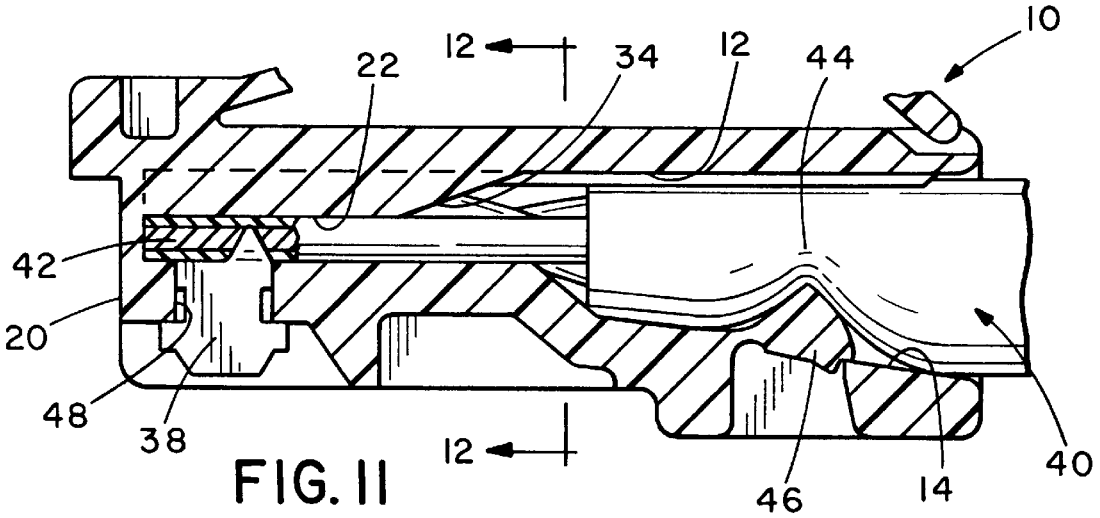
FIG. 11 is a sectional view taken along lines 9—9 of FIG. 2 showing the conductors fully inserted into the connector.
Figure 12:
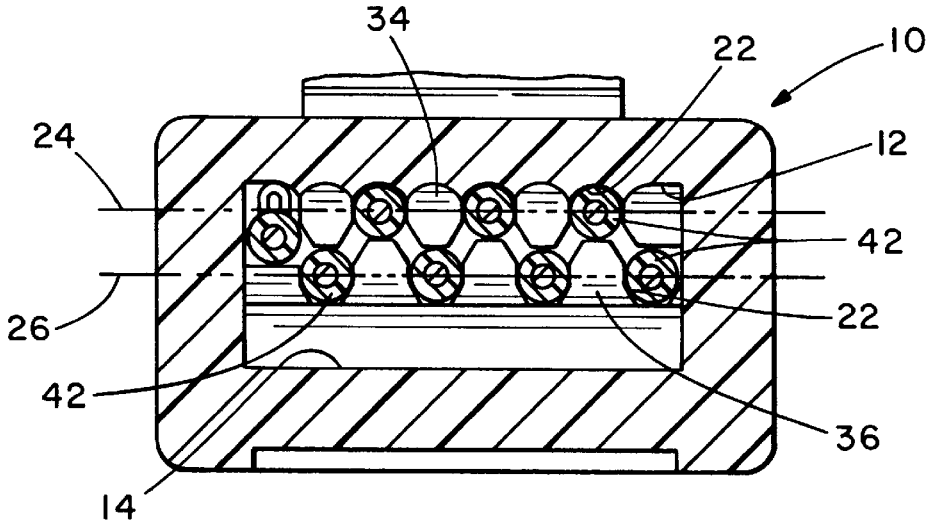
FIG. 12 is a sectional view taken along lines 12—12 of FIG. 11.

As shown in FIG. 4, when terminating a cable 40 to the connector 10 the stripped and aligned conductors 42 are initially inserted against the top interior wall surface 12 which includes a plurality of guide troughs 32 that keep conductors 42 separated and in their proper order. Further insertion guides the conductors 42 to the respective ramp and corresponding conductor positioning channel 22. As can be seen in FIGS. 8 and 9 as the conductors 42 reach the guide ramps 34, 36, upper ramps 34 deflect the alternate conductors 42 downward and into the lower plane 26 of conductor positioning channels 22. After cable 40 and conductors 42 have been fully inserted, conductors 42 can be terminated by the contact blades 38 inserted through a plurality of corresponding contact slots 48 and the strain relief 46 applied to the cable 40 within the connector 10 as shown in FIGS. 11 and 12.

It is to be noted that channel 26 extends into connector 10 as far as practicable since having a smaller parallel run of adjacent conductor pairs reduces cross talk. However, a sufficient length of the stripped end of the wires must be maintained to have enough rigidity to be inserted.

When used to terminate shielded or unshielded 100 ohm cable twisted pair category 5 cable meeting EIA/TIA TSB-36, the final staggered disposition of the distal ends of conductors provides a plug connector that has been found to reduce cross talk induced by the connector an amount sufficient to consistently exceed category 5 cross talk performance as specified by the Electronics Industries Association and the Telecommunication Industry Association, EIA/TIA in specification SP-2840, with the plug and cable tested under TSB-67 certification test equipment for category 5 compliance and the plug alone tested under TSB-40 termination component requirements while providing a connector that can be economically manufactured and easily terminated, without the use of a separate wire loading bar, merely by inserting a planar array of conductors into the connector and terminating the plug connector.

Although the present invention has been described as used in a modular plug connector, it is to be understood that the present invention would be useful in any type of connector to reduce cross talk in a connector where it is desirable to initially position a substantially planar array of conductors in the connector for termination.

While the particular preferred embodiment of the present invention has been shown and described, it will be obvious to those skilled in the art that changes and modifications may be made without departing from the teachings of the invention in its broader aspects. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A connector for terminating a plurality of conductors of a plurality of conductor pairs, comprising:

a connector housing having a rear cable receiving opening formed by a top wall, a bottom wall and a pair of opposing side walls;

a plurality of conductor positioning channels situated within the housing and formed having a pair of spaced apart upper and lower planar arrays; and guide means integral with the housing for guiding the plurality of conductors respectively into the upper and the lower planar arrays of conductor positioning channels.

2. A connector in accordance with claim 1, wherein the guide means includes a plurality of ramp surfaces disposed on the top wall and aligned with respective conductors of the plurality of conductors for positioning said conductors within the lower planar array.

3. A connector in accordance with claim 2 wherein the top ramp surfaces are aligned with alternating conductors.

4. A connector in accordance with claim 2, further including alignment means for maintaining the alignment of the conductors into the respective ramp surfaces during insertion.

5. A connector in accordance with claim 2, wherein the bottom wall includes ramp surfaces aligned with the upper planar array of conductor positioning channels.

6. A connector for terminating a plurality of conductors of a plurality of a conductor pairs, comprising:

a connector housing having a rear cable receiving opening formed by a top wall, a bottom wall and a pair of opposing side walls;

a plurality of conductor positioning channels situated within the housing and formed having a pair of spaced apart upper and lower planar arrays; and a plurality of ramp surfaces aligned with the plurality of conductors for positioning the conductors into the respective spaced apart planes of conductor positioning channels.

7. A connector in accordance with claim 6, wherein the ramp surfaces are disposed on both the top and bottom walls.

8. A connector in accordance with claim 7 wherein the top ramp surfaces are aligned with alternating conductors.

9. A connector in accordance with claim 7, further including alignment means for maintaining the alignment of the conductors into the respective ramp surfaces during insertion.

10. A connector in accordance with claim 7, wherein the bottom wall includes ramp surfaces aligned with the conductor positioning channels of the upper planar array.

* * * * *

UNITED STATES PATENT AND TRADEMARK OFFICE

CERTIFICATE OF CORRECTION

PATENT NO. : 5,906,503
DATED : May 25, 1999
INVENTOR(S) : Wiencek et al.

It is certified that error appears in the above-identified patent and that said Letters Patent is hereby corrected as shown below:

Title page,
Item [73], Assignee: "Pauduit" should read -- Panduit --.

Signed and Sealed this

Fourth Day of February, 2003

JAMES E. ROGAN
*Director of the United States Patent and Trademark Office*